US008292239B1

(12) United States Patent
Elden Limb

(10) Patent No.: US 8,292,239 B1
(45) Date of Patent: Oct. 23, 2012

(54) COLLAPSIBLE FOOD STORAGE BAG HOLDER

(76) Inventor: Linda Kay Elden Limb, Houston, TX (US)

( * ) Notice: Subject to any disclaimer, the term of this patent is extended or adjusted under 35 U.S.C. 154(b) by 112 days.

(21) Appl. No.: 12/823,366

(22) Filed: Jun. 25, 2010

Related U.S. Application Data

(60) Provisional application No. 61/222,566, filed on Jul. 2, 2009.

(51) Int. Cl.
*A63B 55/04* (2006.01)

(52) U.S. Cl. ..... 248/97; 248/95; 248/163.2; 248/164; 248/166; 248/170

(58) Field of Classification Search ..... 248/95, 248/166, 165, 150, 188.6, 100, 431, 97, 175, 248/163.2, 164, 170
See application file for complete search history.

(56) References Cited

U.S. PATENT DOCUMENTS

| | | | | |
|---|---|---|---|---|
| 63,383 | A | 4/1867 | Hanks | |
| D286,099 | S | 10/1986 | Risch | |
| 4,620,683 | A | 11/1986 | Claydon et al. | |
| 4,723,741 | A | 2/1988 | Doering | |
| 4,953,815 | A | 9/1990 | Beymer et al. | |
| D341,687 | S | 11/1993 | Park | |
| D358,704 | S | 5/1995 | Zeisel | |
| 6,213,555 | B1 * | 4/2001 | Sulpizio et al. | 297/377 |
| 6,508,443 | B1 | 1/2003 | Andreasson | |
| 6,722,618 | B1 * | 4/2004 | Wu | 248/166 |
| 7,318,569 | B1 | 1/2008 | Bilotta | |
| D610,768 | S | 2/2010 | Elden Limb | |
| 2007/0164173 | A1 | 7/2007 | Li | |

* cited by examiner

*Primary Examiner* — Amy J. Sterling
(74) *Attorney, Agent, or Firm* — Buskop Law Group, PC; Wendy Buskop

(57) ABSTRACT

A collapsible food storage bag holder for supporting food storage bags. The holder can include supports for supporting food storage bags, connectors for connecting food storage bags to the holder, braces, and bag clips. The supports can be telescoping and can have pivotable arms.

18 Claims, 6 Drawing Sheets

COLLAPSIBLE FOOD STORAGE BAG HOLDER

CROSS REFERENCE TO RELATED APPLICATIONS

The current application claims priority to and the benefit of U.S. Provisional Patent Application Ser. No. 61/222,566 filed on Jul. 2, 2009, entitled "COLLAPSIBLE FOOD STORAGE BAG HOLDER". This reference is incorporated herein in its entirety.

FIELD

The embodiments generally relate to bag holders, collapsible food storage bag holders and kits for assembling a collapsible food storage bag holder.

BACKGROUND

A need exists for a collapsible food storage bag holder that makes the insertion and packaging of food into a food storage bag more quick and easy.

A need exists for a food storage bag holder that is able to hold a food storage bag open, allowing a user to easily view the insertion of food into the food storage bag as well as to view the food within the food storage bag. Viewing the insertion of food into the food storage bag and the food within the food storage bag allows a user to more efficiently, safely, and cost effectively insert food into a food storage bag.

A need exists for a food storage bag holder that is collapsible, allowing for easy storage of the food storage bag holder when it is not in use.

A further need exists for a food storage bag holder kit allowing a user to easily and quickly assemble a collapsible food storage bag holder.

The present embodiments meet these needs.

BRIEF DESCRIPTION OF THE DRAWINGS

The detailed description will be better understood in conjunction with the accompanying drawings as follows.

Figure 1:
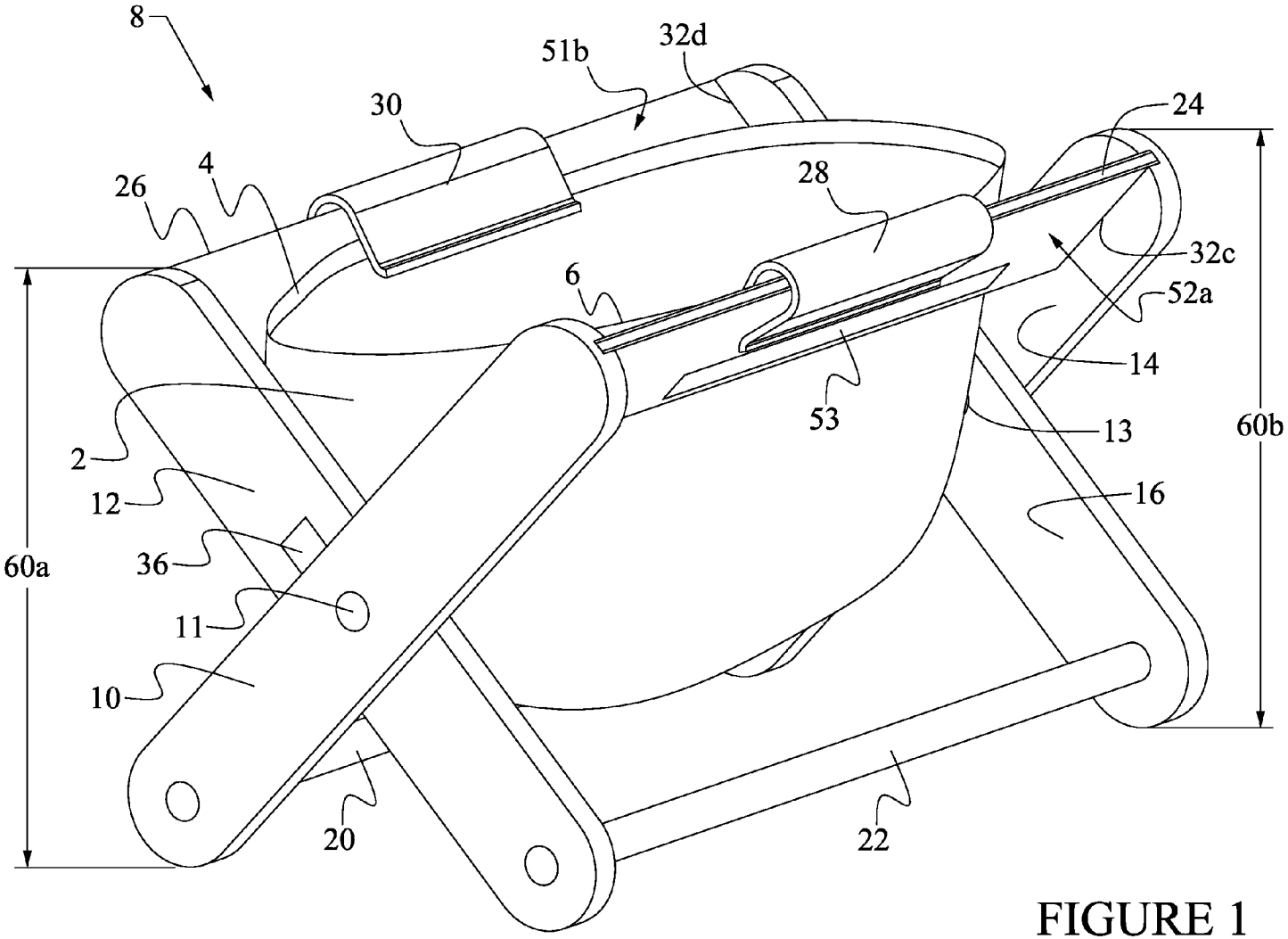
FIG. 1 depicts an embodiment of a collapsible food storage bag holder.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a collapsible food storage bag holder for supporting a food storage bag. The collapsible food storage bag holder is capable of holding a food storage bag open and upright while a user is inserting food into the food storage bag, and enables easy viewing of the food during placement into the bag.

The collapsible food storage bag holder can offer many advantages to users of food storage bags.

This device is very useful for arthritic elderly people and handicapped people that only have one hand, because the device acts as a second hand.

The collapsible food storage bag holder can allow for more efficient packaging of food into food storage bags because large amounts of food can be inserted by only one person into large bags.

It is almost impossible to ladle food into food storage bags without having a helper hold the bag open. This device can enable one person to do all the steps easily without spilling the food.

Since the collapsible food storage bag holder can hold the food storage bag upright and open, a user can more clearly and easily place and view the insertion of food into the food storage bag.

One or more embodiments additionally allow the user to more accurately judge the remaining space left within the food storage bag, and therefore to more efficiently utilize the user's food storage bag capacity. Utilizing the available space within a food storage bag can allow the user to use less food storage bags to store the same amount of food, and therefore can save the user money on purchasing food storage bags.

Also, using a smaller number of food storage bags can produce a smaller impact on the environment. Embodiments are environmentally friendly because less plastic will end up in the trash.

Embodiments can also help prevent the over or under packaging of food into food storage bags, and can prevent spillage of food.

The collapsible food storage bag holder can allow for faster packaging of food into food storage bags by one person. Since the food storage bag is held open by the collapsible food storage bag holder, a user does not need to struggle with holding the food storage bag open, nor does a user have to use one of the user's hands to hold the food storage bag open.

Embodiments also provide for a more sanitary insertion of food into the bag by a holder, because the clean bag is maintained in an upright position without the need for unclean hands touching the bag or accidently touching the food.

The food storage bag holder can be collapsible, allowing for easy storage, and flat packing.

The collapsible food storage bag, after unclipping the bag, can collapse down to a small size, allowing the user to then easily seal the filled bag of food.

Embodiments allow the user to more easily avoid handling and damaging food within the food storage bags. For example, a cake with frosting can be carefully placed inside the bag in the holder without smashing the frosting.

The collapsible food storage bag holder can be lightweight, easily transportable, and can be easily assembled. The holder can collapse to such a small size that it can be hung on a small nail on the inside of a cupboard, or several holders can be stacked together. The collapsible food storage bag holder can fold to a height of about two inches.

The collapsible food storage bag holder can include a support for standing the collapsible food storage bag holder in an upright position. The support can include extensions, such as pivotable arms or telescoping rods, that can form a base. The support can include at least two feet. One or more embodiments can include two or more supports, making the bag holder even more sturdy and rigid for use.

Embodiments can include four supports, however there can be other numbers of supports for the bag holder, depending upon the size of the bag, the need for an extra base support, or the need for another feature.

In embodiments including four supports, a first support can be connected to a second support with a first pivot means. The first pivot means can be a rod, a shaft pivot or any other pivot means known in the art. In embodiments, the pivot means can be a non-threaded rod with a back washer, a bolt or another fastening means to hold the pivot means into the supports. The pivot means can include a $\frac{1}{8}^{th}$ inch diameter rod. The pivot means can be threadably inserted to hold the supports. The pivot means can be a first rod that pivots within a second rod, providing for a smooth fit. The first support and the second support, connected together with the first pivot means, can form an X-shape.

The device can include a third support that can be connected to a fourth support with a second pivot means. The second pivot means can be identical or similar to the first pivot means described above. The third support and the fourth support, connected together with the second pivot means, can form an X-shape.

Braces can be disposed between the supports, providing stability to the collapsible food storage bag holder. In embodiments, at least a first brace can be disposed between the first support and the third support, and at least a second brace can be disposed between the second support and the fourth support. The braces can be used to support another item with a clip, or to hold a second item. For example, a brace can hold a Sharpie™ marker that can then be used to write on the food storage bag for labeling purposes.

Connectors can be disposed between the supports, providing stability to the collapsible food storage bag holder as well as providing a point of attachment. Clips can be attached and supported at the points of attachment. The clips can support and hold open the food storage bags in the collapsible food storage bag holder.

In embodiments, a first connector can be disposed between the first support and the third support, opposite the first brace. A second connector can be disposed between the second support and the fourth support, opposite the second brace. The connectors can be used to present product or company branding, which can enable the holder to be used as a marketing tool in addition to a food storage bag holder.

At least one bag clip can be disposed on each respective connector. In embodiments, a first bag clip can be disposed on the first connector and a second bag clip can be disposed on the second bag connector. The bag clips can be spring clips or another type of clip known in the art. The bag clips can be formed of plastic, metal, wood, or any other suitable material. One or more embodiments can include binder clips disposed on each respective connector. The binder clips can be from about ¼ inch to about ¾ inch in size. Embodiments can include plastic clips disposed on each respective connector. The plastic clips can have a long arm with a spring, such as a four inch long pair of plastic arms that are connected with a spring. The bag clips, binder clips, and plastic clips can all be rust proof and dishwasher safe.

The collapsible food storage bag holder can hold a food storage bag, such as a Ziploc™ bag or a similar zippered, leak proof, drip proof, sealing bag (not a folding bag) that has a first upper edge which can be sealably connected to a second upper edge.

The holder can be designed for bags that will hold liquids, solid foods, or liquid and solid food combinations. The holder can be usable with zipping sealing bags, which can be the hardest to hold with one hand and will often not retain their shape or stand upright for the insertion of liquids, such as soups.

The first bag clip and the second bag clip can each engage one of the upper edges of the food storage bag. The bag clips supporting the food storage bag can be disposed between the first support, second support, third support, and fourth supports. The braces of the supports can also support the bag in the holder.

In embodiments, the connectors can be slidably engaged with grooves that can be formed in a top of the supports. The grooves can be formed on each support, making the connectors and supports removable from each other, and enabling a kit of the holder to be formed.

The supports, braces, and connectors can each have a shape that is a cylinder, a plate, a tubular square, or combinations thereof.

The braces, supports, and connectors can each be made of plastic, metal, wood, or any other suitable material known in the art.

The collapsible food storage bag holder can be designed to be lightweight, allowing for easy transportation. The supports, braces, and connectors can each be hollow, thereby enabling the collapsible food storage bag holder to have a weight of no more than about six ounces. The braces, connectors and supports can be perforated.

The collapsible food storage bag holder can have a locking fastener disposed on at least one of the supports for locking the supports into an open position or a closed position. In embodiments, the pivot means can include a locking fastener for locking the supports into an open position or a closed position. The locking fastener can be part of the pivot means, such as a ratchet means. The locking fastener can be connected to the pivot means to hold the supports open for filling of the storage food bag. The collapsible food storage bag holder can collapse after unclipping for easier manipulation and closure of the food storage bag.

In the open position, the first support and second support can form a substantially x-shaped first stand member that can be collapsible. The first support and second support can overlap each other. In the open position, the third and fourth supports can form a substantially x-shaped second stand member that can also be collapsible. The third support and fourth support can overlap each other.

In embodiments, telescoping rods can be secured into each of the supports. Each telescoping rod can extend from each respective support and can lock into place, such as by turning the telescoping rod about a set of threads. The telescoping rods can be used to adjust the size of the collapsible food storage bag holder for supporting different sized food storage bags. The telescoping rods can enable the holder to be used with snack sized food bags, one gallon sized food storage bags, or any commercially available food storage bag, such as those sold by Glad™ or Ziploc™ In one or more embodiments the supports can be telescoping supports.

In embodiments, the pivotable arms can be secured to each of the supports. Each pivotable arm can extend from each respective support, and can lock into place to support a various sized food storage bags. The pivotable arms can be flat and non tubular. The flat pivotable arms can add versatility to the holder while providing the collapsibility and compactness. The flat pivotable arms can have a small mass for storage and flat pack shipping.

In embodiments, the device can have both pivotable arms and telescoping arms. The pivotable arms can be used as a base to hold the collapsible food storage bag holder. The telescoping arms can be used for the large or custom sized food storage bag.

The entire collapsible food storage bag holder can be made from plastic or metal. The plastics can include polypropylene, polyethylene, various copolymers, polyvinyl chloride, composites, graphite composites, or other similar plastics. The composites can enable the holder to be extremely light weight, such as less than about two ounces, while still being sturdy enough to hold bags opened. In one more embodiments, the collapsible food storage bag holder can be made of a material that is non-deformable in the presence of cleansing materials and sanitizing heat, such as detergents and heat in a dishwasher.

The holder can enable a user to secure one of a variety of sizes and types of food storage bags, to fill the bag and to close the bag; all while only using one hand. The holder can therefore allow user's with injured hands, arthritis, or amputations to pack and store food securely into the holder.

The sizes of bags that can be used with the holder can include quart sized food storage bags, gallon sized food storage bags, snack sized food storage bags, and other custom sized food storage bags, including bags designed for storing food in freezers.

In one or more embodiments, the supports can have a length from about seven inches to about nine inches, and the connectors can have a length from about five inches to about eight inches. The supports and connectors can have larger or smaller dimensions for holding larger or smaller bags. The holder, when open, can be about fourteen inches tall.

The connectors can include a connector surface adapted for presenting a message. For example, the message can be a phrase, such as "Eat at Linda's", or a company brand, such as "Limb Design of Houston, Tex." The message can be printed, etched, embossed, or formed as part of a molding process on the connector.

In embodiments, the holder can be used as a marketing device. The holder can be lightweight, inexpensive, compact, foldable and transportable, therefore being ideal for use for promoting a business.

In embodiments, the holder can have printed information, such as a hospital number or doctor contact information, enabling the user to easily find the number in case of an emergency.

One or more embodiments relate to a kit of the collapsible food storage bag holder. The kit can include: the supports, the braces, the connectors, the pivot means, and the bag clips; all disassembled. The kit can include instructions so that a user can quickly and easily assemble the collapsible food storage bag holder. Each component of the kit can be dishwasher safe.

Turning now to FIG. 1, a collapsible food storage bag holder 8 is depicted. A first support 10 is shown connected to a second support 12 by a first pivot means 11.

A third support 14 is shown connected to a fourth support 16 by a second pivot means 13.

A first brace 20 is shown disposed between the first support 10 and the third support 14. A second brace 22 is shown disposed between the second support 12 and the fourth support 16.

A first stand member 60*a* is depicted formed by the first support 10 and the second support 12. A second stand member 60*b* is depicted formed by the third support 14 and the fourth support 16. The stand members 60*a* and 60*b* can form an X-shape while in an opened position.

The collapsible food storage bag holder 8 is shown in the opened position, and is locked in that position by locking fastener 36.

Grooves 32*c* and 32*d* are depicted disposed on the third support 14 and the fourth support 16, opposite the first brace 20 and the second brace 22. The first support 10 and the second support 12 can also have grooves.

A first connector 24 is depicted disposed within the groove 32*c*. A second connector 26 is depicted disposed within the groove 32*d*. The second connector 26 is depicted with an inside surface 51*b*. The first connector 24 is depicted with an outside surface 52*a*. A connector surface 53 can be disposed on the outside surface 52*a*, whereon a message can be displayed.

A first bag clip 28 is shown connected to an upper edge 6 of a food storage bag 2. A second bag clip 30 is shown connected to an upper edge 4 of the food storage bag 2. The bag clips can be removable or an integral one-piece structure with the connectors. For example, the bag clips can be integrally formed in a plastic mold with the connectors. The collapsible food storage bag holder can be formed of two molded units, which can be engagable at the supports; thereby allowing for fast commercial production.

The collapsible food storage bag holder 8 can hold the bag 2 in an upright and opened position, allowing for easy, fast, safe, and efficient insertion of food into the bag 2.

Figure 2:
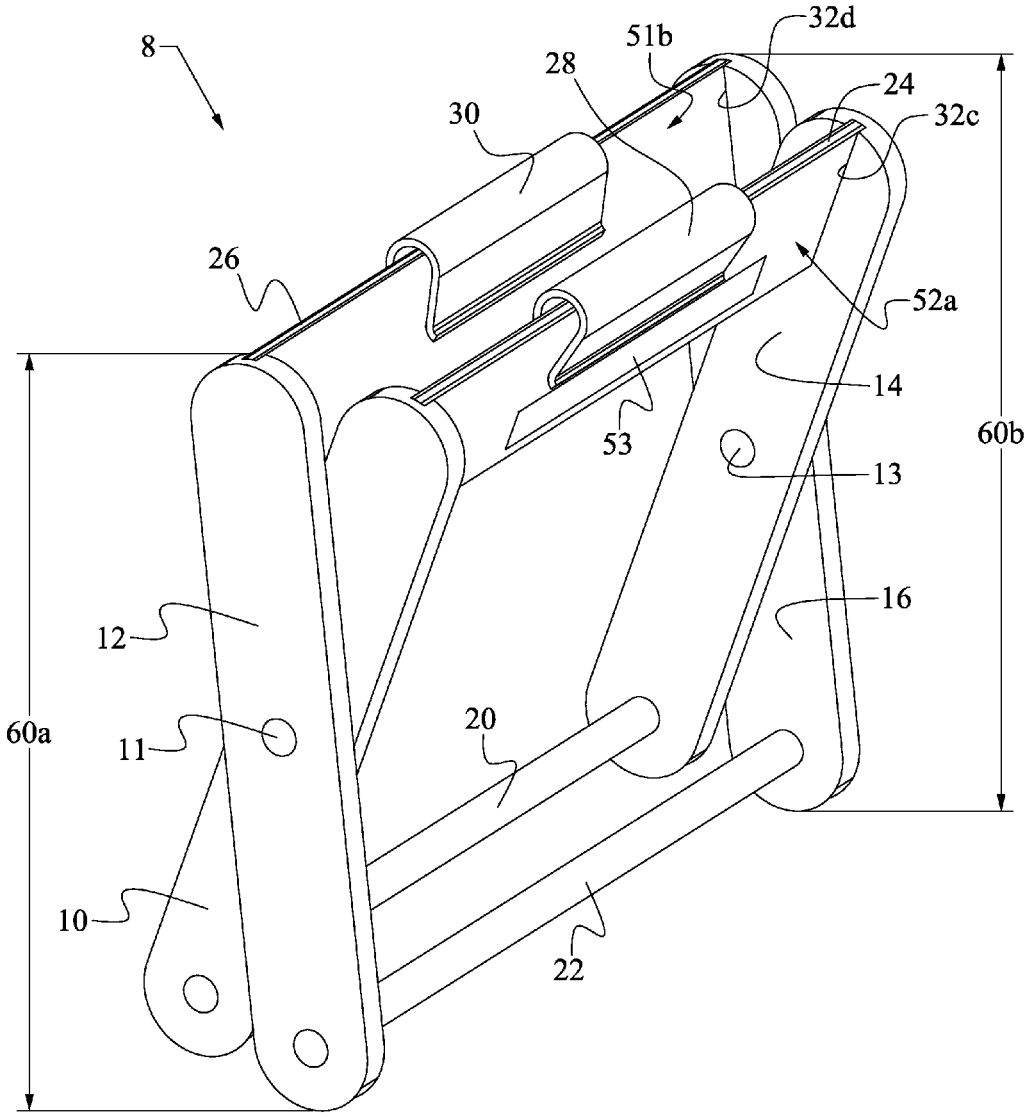
FIG. 2 depicts the embodiment shown in FIG. 1 in a closed position.

FIG. 2 depicts the collapsible food storage bag holder 8 in a closed position, and without a food storage bag attached thereto.

Figure 3:
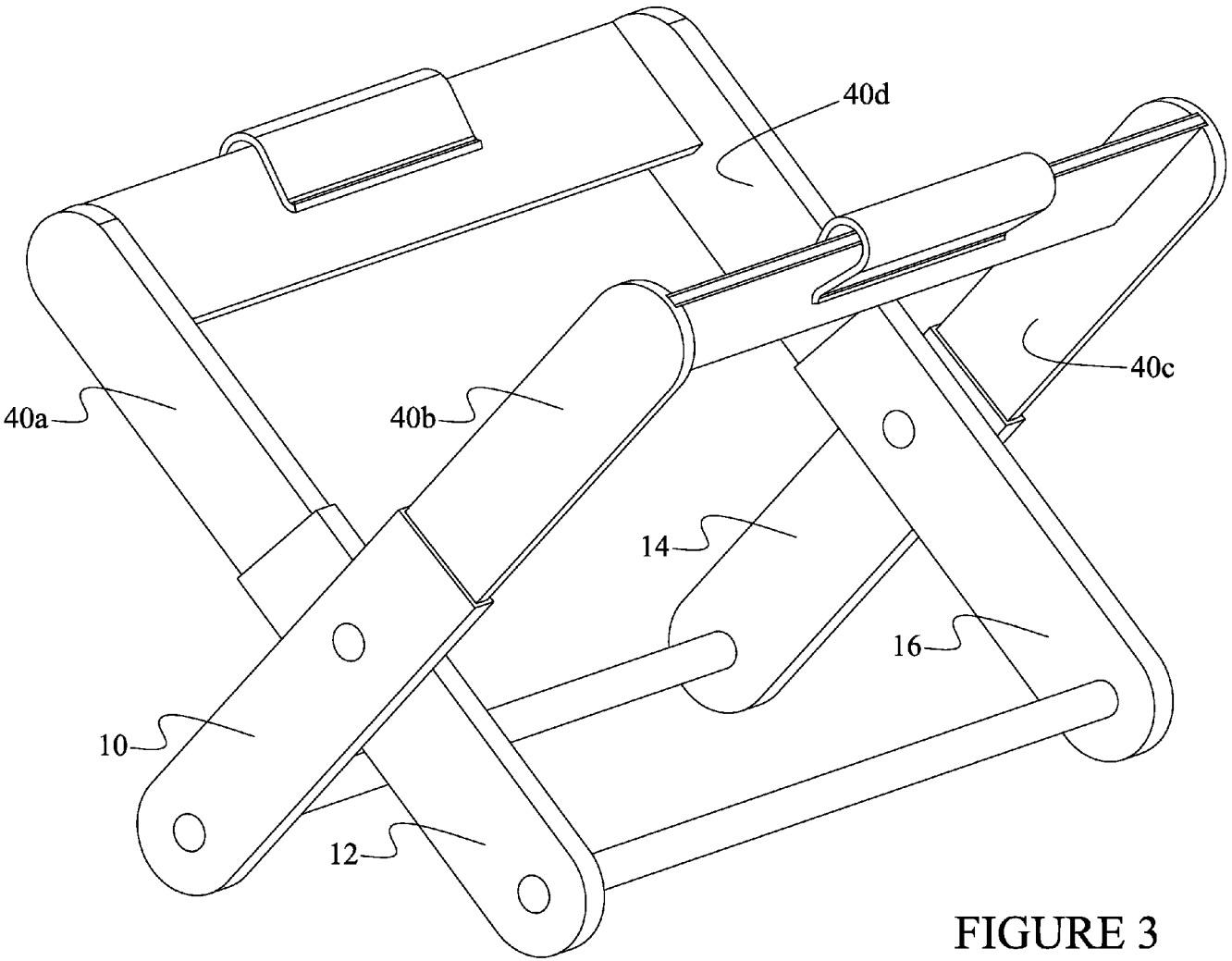
FIG. 3 depicts an embodiment of a collapsible food storage bag holder with telescoping arms.

FIG. 3 depicts the collapsible food storage bag holder with telescoping arms 40*a*, 40*b*, 40*c*, and 40*d*. The telescoping arms can be connected to the first support 10, second support 12, third support 14, and fourth support 16. The telescoping arms 40*a*, 40*b*, 40*c*, and 40*d* are depicted extended, however they can also be retracted.

The telescoping arms 40*a*, 40*b*, 40*c*, and 40*d* can allow the collapsible food storage bag holder to hold a larger food storage bag. When the telescoping arms 40*a*, 40*b*, 40*c*, and 40*d* are retracted, the apparatus can be substantially similar to the collapsible food storage bag holder depicted in FIG. 1.

Figure 4:
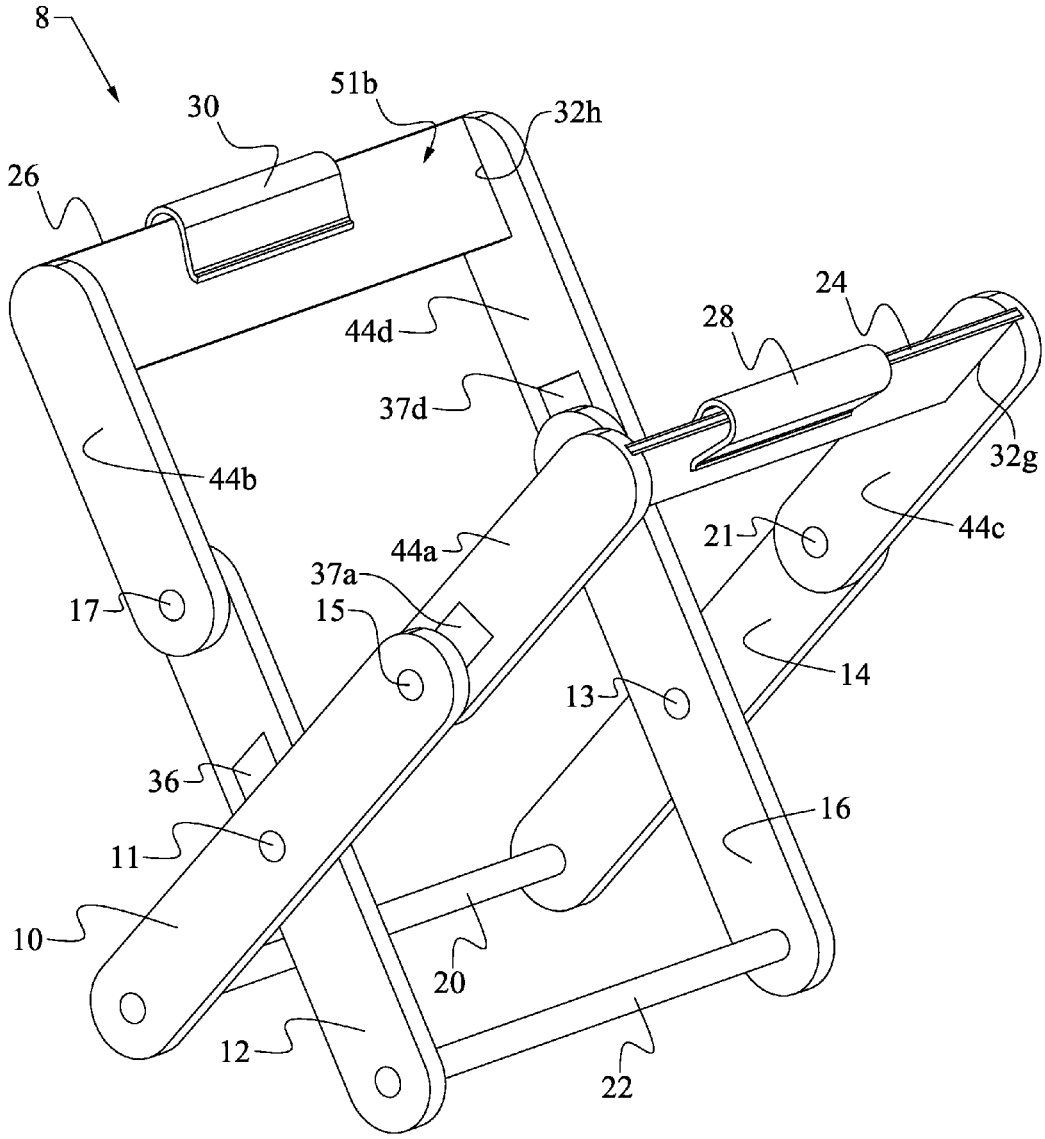
FIG. 4 depicts an embodiment of a collapsible food storage bag holder with pivotable arms.

FIG. 4 depicts the collapsible food storage bag holder 8 with pivotable arms 44*a*, 44*b*, 44*c*, and 44*d*. The pivotable arms can be connected to the first support 10, second support 12, third support 14, and fourth support 16 with a third pivot means 15, a fourth pivot means 17, and a sixth pivot means 21. The pivotable arms 44*a*, 44*b*, 44*c*, and 44*d* are depicted in an opened position, however they can also be folded into a closed position.

The pivotable arms 44*a*, 44*b*, 44*c*, and 44*d* can be provided with grooves substantially similar as those described above with respect to the first support arm 10, second support arm 12, third support arm 14 and fourth support arm 16. The grooves 32*g* and 32*h* are depicted connected to pivotable arms 44*c* and 44*d*.

The first connector 24 and the second connector 26 can be slidably engaged with the grooves 32*g* and 32*h*, as well as corresponding grooves disposed in the pivotable arms 44*a* and 44*b*.

The pivotable arms 44*a*, 44*b*, 44*c*, and 44*d* can allow the collapsible food storage bag holder 8 to hold a larger food storage bag than when the pivotable arms are not extended. Also depicted are locking fastener 36 and locking fastener 37*a* and 37*d*.

Figure 5:
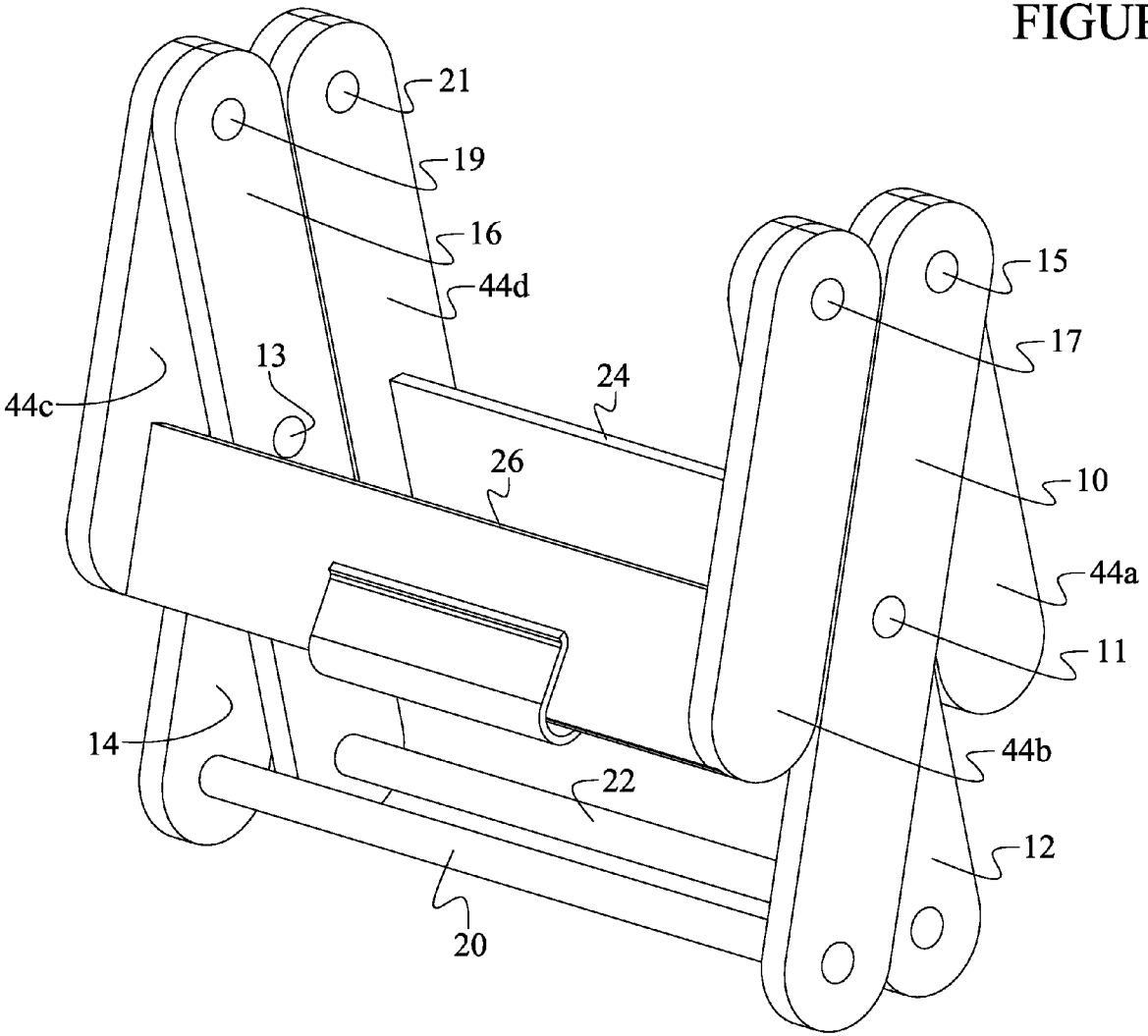
FIG. 5 depicts the embodiment of FIG. 4 with the pivotable arms folded into a closed position.

FIG. 5 depicts the collapsible food storage bag holder with the pivotable arms 44*a*, 44*b*, 44*c*, and 44*d* in a closed position. Also depicted are the third pivot means 15, fourth pivot means 17, fifth pivot means 19, and sixth pivot means 21.

In operation, the first connector 24 and the second connector 26 can be removed from the slidable engagement with the grooves 32*g* and 32*h*, as well as the corresponding grooves disposed in pivotable arms 44*a* and 44*b*. The pivotable arms 44*a*, 44*b*, 44*c*, and 44*d* can then be folded into a closed position, and the first connector 24 and the second connector 26 can be slidably engaged with the grooves. With the pivotable arms 44*a*, 44*b*, 44*c*, and 44*d* in the closed position, the collapsible food storage bag holder can be substantially similar the embodiment depicted in FIG. 1.

Figure 6:
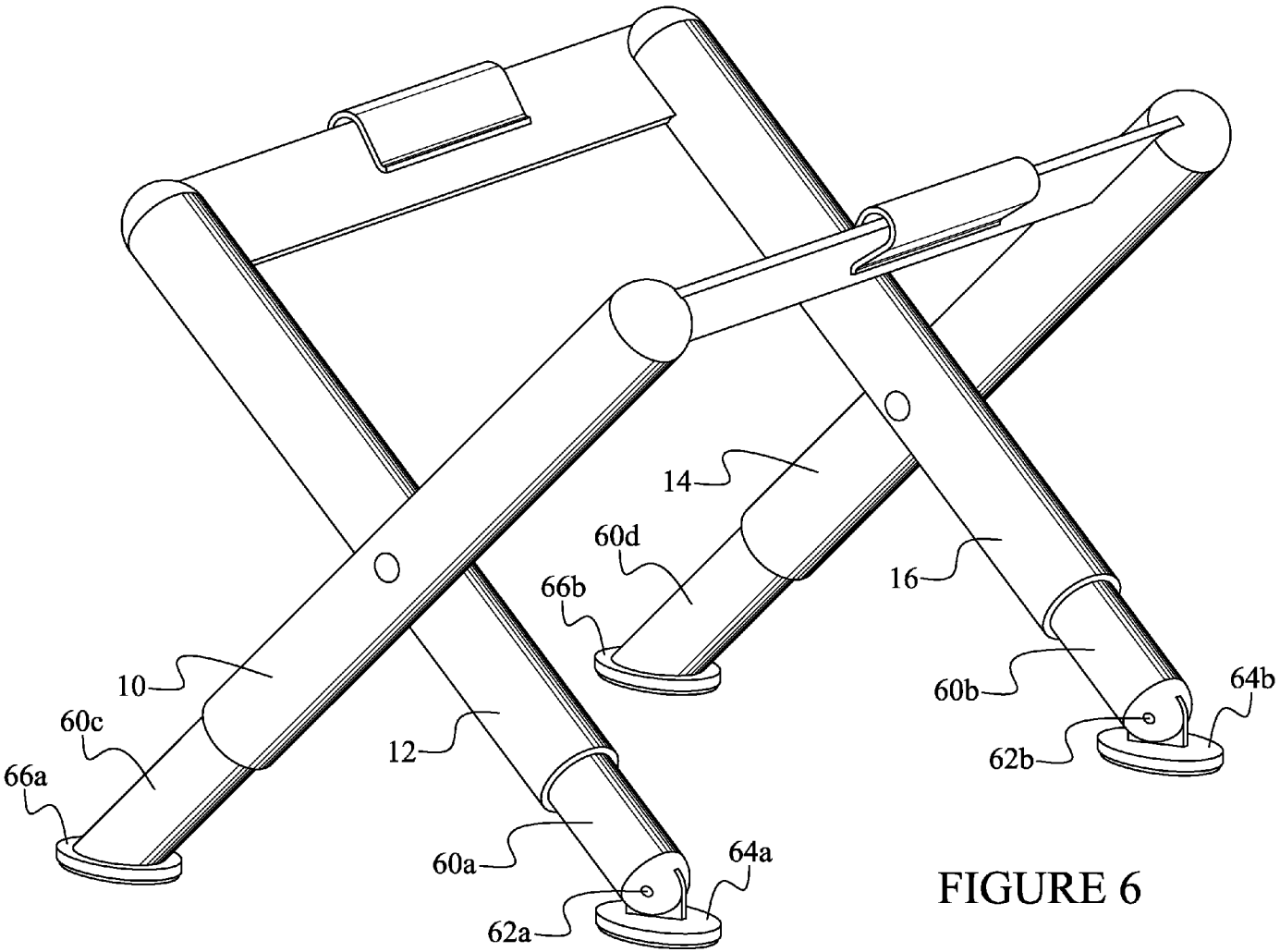
FIG. 6 depicts an embodiment of a collapsible food storage bag holder with telescoping legs.

FIG. 6 depicts an embodiment of a collapsible food storage bag holder with telescoping legs 60*a*, 60*b*, 60*c* and 60*d*. The telescoping legs can be connected to the first support 10, second support 12, third support 14, and fourth support 16. In an embodiment the supports can also be telescoping.

The telescoping legs 60*a*, 60*b*, 60*c* and 60*d* can allow the collapsible food storage bag holder to hold a larger food storage bag. When the telescoping legs 60*a*, 60*b*, 60*c*, and 60*d* are retracted, the collapsible food storage bag holder can be substantially similar to the embodiment depicted in FIG. 1.

The telescoping legs 60*a*, 60*b*, 60*c* and 60*d* can have pivotable feet 64*a* and 64*b*. The pivotable feet 64*a* and 64*b* can pivot on leg pivots 62*a* and 62*b*. The pivotable feet 64*a* and 64*b* can ensure a solid contact with a surface regardless of the position of the supports. While only telescoping legs 60*a* and 60*b* are depicted with pivotable feet, all of the telescoping legs can have pivotable feet disposed on them.

The telescoping legs 60*a*, 60*b*, 60*c* and 60*d* can have stationary feet 66*a* and 66*b*. While only telescoping legs 60*c* and 60*d* are depicted with stationary feet, all of the telescoping legs can have stationary feet disposed on them.

While these embodiments have been described with emphasis on the embodiments, it should be understood that within the scope of the appended claims, the embodiments might be practiced other than as specifically described herein.

What is claimed is:

1. A collapsible food storage bag holder for a food storage bag with a first upper edge and a second upper edge, wherein the first upper edge is sealably connectable to the second upper edge, wherein the collapsible food storage bag holder comprises:

a. a first support;

b. a second support, wherein the second support is connected to the first support with a first pivot means, wherein the first pivot means is connected to the first support substantially midway between a top of the first support and a bottom of the first support, and wherein the first pivot means is connected to the second support substantially midway between a top of the second support and a bottom of the second support;

c. a third support;

d. a fourth support, wherein the fourth support is connected to the third support with a second pivot means, wherein the second pivot means is connected to the third support substantially midway between a top of the third support and a bottom of the third support, and wherein the second pivot means is connected to the fourth support substantially midway between a top of the fourth support and a bottom of the fourth second support;

e. a first brace disposed between the first support and the third support, wherein the first brace is proximate the bottom of the first support and the bottom of the third support;

f. a second brace disposed between the second support and the fourth support, wherein the second brace is proximate the bottom of the second support and the bottom of the fourth support;

g. a first connector disposed between the first support and the third support, wherein the first connector is proximate the top of the first support and the top of the third support top, wherein the first connector is a plate having an outside surface and an inside surface, wherein a first bag clip is engaged over a top edge of the first connector, wherein the first bag clip extends from the top edge of the first connector towards a bottom edge of the first connector and engages the outside surface and the inside surface of the first connector, and wherein an entirety of the first bag clip is disposed above the bottom edge of the first connector;

h. a second connector disposed between the second support and the fourth support, wherein the second connector is proximate the top of the second support and the top of the fourth support top, wherein the second connector is a plate having an outside surface and an inside surface, wherein a second bag clip is engaged over a top edge of the second connector, wherein the second bag clip extends from the top edge of the second connector towards a bottom edge of the second connector and engages the outside surface and the inside surface of the second connector, and wherein an entirety of the second bag clip is disposed above the bottom edge of the second connector; and i. a telescoping rod disposed within each of the first support, the second support, the third support, and the fourth support, wherein each telescoping rod is configured to extend and lock into place to support the food storage bag;

wherein the collapsible food storage bag holder is collapsible between an opened position and a closed position;

wherein, in the opened position, the first support and the second support form a substantially x-shaped first stand member, and the third support and the fourth support form a substantially x-shaped second stand member;

wherein, in the closed position, the first support and the second support are substantially parallel, and the third support and the fourth support are substantially parallel; and wherein, in the opened position, the first bag clip and the second bag clip each engage one of the first upper edge or the second upper edge of the food storage bag, thereby supporting the food storage bag between the first support, the second support, the third support, and the fourth support, and enabling a user to easily view and insert food into the food storage bag.

2. The collapsible food storage bag holder of claim 1, wherein the first connector and the second connector are slidably engaged with grooves, wherein the grooves are formed on the first support, the second support, the third support, and the fourth support, and wherein the grooves extend only partially into the first support, the second support, the third support, and the fourth support.

3. The collapsible food storage bag holder of claim 1, wherein the first brace and the second brace each have a shape selected from the group consisting of: a cylinder, a plate, a square tubular, and combinations thereof.

4. The collapsible food storage bag holder of claim 1, wherein the first brace, the second brace, the first connector, the second connector, the first support, the second support, the third support, and the fourth support are each hollow, enabling the collapsible food storage holder to have a weight of no greater than six ounces, thereby allowing for lightweight transportation of the collapsible food storage holder.

5. The collapsible food storage bag holder of claim 1, further comprising a locking fastener is disposed on at least one of the first support, the second support, the third support, the fourth support, the first pivot means, or the second pivot mean, for locking the collapsible food storage bag holder into the opened position or into the closed position.

6. The collapsible food storage bag holder of claim 1, further comprising a pivotable arm secured to each of the first support, the second support, the third support, and the fourth support, wherein each pivotable arm is extendable, and wherein each pivotable arm further comprises a locking fastener for locking the pivotable arm into place to support the food storage bag.

7. The collapsible food storage bag holder of claim 1, wherein the collapsible food storage bag holder is made from a plastic or a metal, and wherein the collapsible food storage bag holder is non-deformable in the presence of heat.

8. The collapsible food storage bag holder of claim 1, wherein the food storage bag is a snack sized food storage bag, a sandwich sized food storage bag, a quart sized good storage, or a gallon sized food storage bag.

9. The collapsible food storage bag holder of claim 1, wherein each support has a length from seven inches to nine inches, and wherein each connector has a length from five inches to eight inches.

10. The collapsible food storage bag holder of claim 1, wherein each connector comprises a connector surface for presenting a message.

11. A collapsible food storage bag holder kit, comprising at least the following components:

a. a first support, a second support, a third support and a fourth support;

b. a first brace and a second brace;

c. a first connector and a second connector, wherein the first connector and the second connector are both plates having an outside surface, an inside surface, a top edge, and a bottom edge;

d. a first pivot means and a second pivot means;

e. a telescoping rod disposed within the first support, the second support, the third support, and the fourth support, wherein each telescoping rod is configured to extend from the first support, the second support, the third support, and the fourth support, and wherein each telescoping rod is adapted to lock into place to support a food storage bag; and f. a first bag clip and a second bag clip, wherein the first bag clip is engageable over the top edge of the first connector to extend towards the bottom edge of the first connector and engage with the outside surface and the inside surface of the first connector with an entirety of the first bag clip disposed above the bottom edge of the first connector, wherein the second bag clip is engageable over the top edge of the second connector to extend towards the bottom edge of the second connector and engage with the outside surface and the inside surface of the second connector with an entirety of the second bag clip disposed above the bottom edge of the second connector, and wherein the components are adapted to be assembled into a collapsible food storage bag holder.

12. The collapsible food storage bag holder kit of claim 11, wherein each connector is slidably engageable with grooves, wherein the grooves are formed on each support, and wherein the grooves extend only partially into each support.

13. The collapsible food storage bag holder kit of claim 11, wherein each brace has a shape selected from the group consisting of: a cylinder, a plate, a tubular square, and combinations thereof.

14. The collapsible food storage bag holder kit of claim 11, wherein each brace, each connector, and each support is hollow, enabling the collapsible food storage holder to have a weight of no greater than six ounces, thereby allowing for lightweight transportation of the collapsible food storage holder.

15. The collapsible food storage bag holder kit of claim 11, further comprising a locking fastener disposed on each support or each pivot means for locking the collapsible food storage bag holder into an opened position or a closed position.

16. The collapsible food storage bag holder kit of claim 11, further comprising pivotable arms, wherein one pivotable arm is secured to each of the first, second, third, and fourth supports, wherein each pivotable arm can extend from each of the first, second, third, and fourth supports, and wherein the pivotable arms further comprise locking fasteners for locking the pivotable arms into place, to support a food storage bag.

17. The collapsible food storage bag holder kit of claim 11, wherein the collapsible food storage bag holder is made from a plastic or a metal, and wherein the collapsible food storage bag holder is non-deformable in the presence of heat.

18. The collapsible food storage bag holder kit of claim 11, wherein at least one of the connectors comprises a connector surface for presenting a message.

* * * * *